US012630939B2

(12) United States Patent
Tsuji et al.

(10) Patent No.: US 12,630,939 B2
(45) Date of Patent: May 19, 2026

(54) PLATING METHOD AND PLATING APPARATUS

(71) Applicant: EBARA CORPORATION, Tokyo (JP)

(72) Inventors: Kazuhito Tsuji, Tokyo (JP); Mizuki Nagai, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 938 days.

(21) Appl. No.: 17/802,447

(22) PCT Filed: Dec. 6, 2021

(86) PCT No.: PCT/JP2021/044645
§ 371 (c)(1),
(2) Date: Aug. 25, 2022

(87) PCT Pub. No.: WO2023/105561
PCT Pub. Date: Jun. 15, 2023

(65) Prior Publication Data

US 2024/0209542 A1 Jun. 27, 2024

(51) Int. Cl.
*C25D 21/10* (2006.01)
*C25D 21/04* (2006.01)

(52) U.S. Cl.
CPC ..... *C25D 21/10* (2013.01); *C25D 21/04* (2013.01)

(58) Field of Classification Search
None
See application file for complete search history.

(56) References Cited

U.S. PATENT DOCUMENTS 7,223,323 B2 * 5/2007 Yang ..... C25D 7/123 204/228.8
2004/0055876 A1 3/2004 Browne et al.
2008/0271995 A1 * 11/2008 Savastiouk ..... H05K 3/423 205/148
2014/0299476 A1 * 10/2014 Yasuda ..... C25D 5/18 205/131
2021/0102295 A1 * 4/2021 Okuda ..... C25D 17/02
(Continued)

FOREIGN PATENT DOCUMENTS

JP 2004-225129 A 8/2004
JP 2004-363422 A 12/2004
JP 2005-264245 A 9/2005
(Continued)

*Primary Examiner* — Stefanie S Wittenberg
(74) *Attorney, Agent, or Firm* — BakerHostetler

(57) ABSTRACT

Provided is a technique that allows removing gas bubbles attached to a hole of an ionically resistive element.
A plating method includes: stirring a plating solution by driving a paddle arranged above the ionically resistive element in a state where an anode and the ionically resistive element are immersed in the plating solution (step S20); immersing a substrate as a cathode in the plating solution in a state where the stirring of the plating solution with the paddle is stopped (step S40); resuming the stirring of the plating solution with the paddle arranged above the ionically resistive element and below the substrate in a state where the substrate is immersed in the plating solution (step S50); and performing a plating process on the substrate by flowing electricity between the substrate and the anode in a state where the stirring of the plating solution with the paddle is resumed (step S60).

9 Claims, 12 Drawing Sheets

(56) References Cited

U.S. PATENT DOCUMENTS

| | | | | |
|---|---|---|---|---|
| 2021/0262111 | A1 | 8/2021 | Masuda et al. | |
| 2022/0162767 | A1* | 5/2022 | Wang | C25D 21/04 |

FOREIGN PATENT DOCUMENTS

| | | | |
|---|---|---|---|
| JP | 2006-152415 | A | 6/2006 |
| JP | 2008-019496 | A | 1/2008 |
| JP | 2021-130848 | A | 9/2021 |
| JP | 6937972 | B1 | 9/2021 |
| KR | 2021-0106361 | A | 8/2021 |

* cited by examiner

PLATING METHOD AND PLATING APPARATUS

TECHNICAL FIELD

The present invention relates to a plating method and a plating apparatus.

BACKGROUND ART

Conventionally, there has been known what is called a cup type plating apparatus as a plating apparatus that allows performing a plating process on a substrate (for example, see PTL 1). Such plating apparatus includes a plating tank that accumulates a plating solution, a substrate holder that holds a substrate as a cathode, a rotation mechanism that rotates the substrate holder, and an elevating mechanism that moves up and down the substrate holder.

Furthermore, conventionally, for example, for ensuring an in-plane uniformity of film thickness of a plating film, there has been known a technique of arranging an ionically resistive element having a plurality of holes inside the plating tank (for example, see PTL 2).

CITATION LIST

Patent Literature

PTL 1: Japanese Unexamined Patent Application Publication No. 2008-19496

PTL 2: Japanese Unexamined Patent Application Publication No. 2004-363422

SUMMARY OF INVENTION

Technical Problem

In a case where an ionically resistive element is arranged inside the plating tank of the cup type plating apparatus as illustrated in PTL 1 described above, in a hypothetical case where a large amount of gas bubbles included in the plating solution of the plating tank are attached to the holes of the ionically resistive element, these gas bubbles attached to the holes may possibly cause a plating quality of the substrate to deteriorate.

The present invention has been made in view of the above, and one of the objects of the present invention is to provide a technique that allows removing gas bubbles attached to a hole of an ionically resistive element.

Solution to Problem (Aspect 1)

To achieve the above-described object, a plating method according to one aspect of the present invention includes: supplying a plating solution to a plating tank provided with an anode and an ionically resistive element arranged above the anode and having a plurality of holes, and immersing the anode and the ionically resistive element in the plating solution; stirring the plating solution by driving a paddle arranged above the ionically resistive element in a state where the anode and the ionically resistive element are immersed in the plating solution; immersing a substrate as a cathode in the plating solution in a state where the stirring of the plating solution with the paddle is stopped; resuming the stirring of the plating solution with the paddle arranged above the ionically resistive element and below the substrate in a state where the substrate is immersed in the plating solution; and performing a plating process on the substrate by flowing electricity between the substrate and the anode in a state where the stirring of the plating solution with the paddle is resumed.

With this aspect, for example, even in a case where gas bubbles included in the plating solution are attached to the hole of the ionically resistive element when supplying the plating solution to the plating tank, the stirring of the plating solution with the paddle can accelerate an upward movement of the gas bubbles attached to the hole. Accordingly, the gas bubbles attached to the hole of the ionically resistive element can be removed.

In addition, with this aspect, since the substrate is immersed in the plating solution in a state where the stirring of the plating solution with the paddle is stopped, waves generating on a liquid surface of the plating solution caused by the stirring of the plating solution with the paddle when immersing the substrate in the plating solution can be suppressed. Accordingly, a large amount of the gas bubbles getting attached to the substrate when the substrate is immersed in the plating solution can also be suppressed.

In addition, with this aspect, since the stirring of the plating solution with the paddle is resumed in a state where the substrate is immersed in the plating solution, the plating solution can be effectively supplied to the substrate. Accordingly, for example, a pre-wet process liquid remaining inside a wiring pattern of the substrate can be effectively replaced with the plating solution.

In addition, with this aspect, since the plating process is performed in a state where the stirring of the plating solution with the paddle is resumed, the plating solution can be effectively supplied to the substrate during the plating process. Accordingly, a plating film can be effectively formed on the substrate.

(Aspect 2)

Aspect 1 described above may further include causing the plating solution to overflow from the plating tank in a state where the stirring of the plating solution with the paddle is stopped, in which the immersing of the substrate in the plating solution in a state where the stirring of the plating solution with the paddle is stopped may be performed after causing the plating solution to overflow from the plating tank.

With this aspect, gas bubbles floating above the ionically resistive element can be discharged outside the plating tank together with the plating solution that overflows from the plating tank. Accordingly, when the substrate is immersed in the plating solution, the gas bubbles getting attached to the substrate can be effectively suppressed.

(Aspect 3)

Aspect 1 or 2 described above may further include: pulling the substrate out of the plating solution after a plating process is performed on the substrate; stirring the plating solution by driving the paddle arranged above the ionically resistive element in a state where the substrate is pulled out of the plating solution; immersing a second substrate in the plating solution in a state where the stirring of the plating solution with the paddle is stopped; resuming the stirring of the plating solution with the paddle arranged above the ionically resistive element and below the second substrate in a state where the second substrate is immersed in the plating solution; and performing a plating process on the second substrate by flowing electricity between the second substrate and the anode in a state where the stirring of the plating solution with the paddle is resumed.

(Aspect 4)

In any one of Aspects 1 to 3 described above, the immersing of the substrate in the plating solution in a state where the stirring of the plating solution with the paddle is stopped may include immersing the substrate in the plating solution in a state where the stirring of the plating solution with the paddle is stopped and in a state where a surface to be plated of the substrate is inclined with respect to a horizontal direction.

(Aspect 5)

Aspect 4 described above may further include returning the surface to be plated of the substrate in a state of being immersed in the plating solution to the horizontal direction, in which the resuming of the stirring of the plating solution with the paddle in a state where the substrate is immersed in the plating solution may be performed after returning the surface to be plated of the substrate in a state of being immersed in the plating solution to the horizontal direction.

In a hypothetical case where the stirring of the plating solution with the paddle is resumed in a state where the surface to be plated of the substrate is inclined with respect to the horizontal direction, since an upper end of the surface to be plated of the substrate in an inclined state becomes close to the liquid surface of the plating solution, when waves generate on the liquid surface of the plating solution by resuming the stirring of the plating solution with the paddle, gas bubbles may possibly easily be drawn to the surface to be plated of the substrate. In contrast to this, with this aspect, since the stirring of the plating solution with the paddle is resumed after the surface to be plated of the substrate in a state of being immersed in the plating solution is returned to the horizontal direction, even in a hypothetical case where waves generate on the liquid surface of the plating solution by resuming the stirring of the plating solution with the paddle, gas bubbles being drawn to the surface to be plated of the substrate can be effectively suppressed.

(Aspect 6)

In Aspect 1 described above, a flow rate of the plating solution flowing from a lower surface side of the ionically resistive element, passing through the plurality of holes, and flowing toward an upper surface side of the ionically resistive element when stirring the plating solution by driving the paddle in a state where the anode and the ionically resistive element are immersed in the plating solution may be greater than a flow rate of the plating solution when performing a plating process on the substrate.

With this aspect, gas bubbles attached to the hole of the ionically resistive element can be effectively removed.

(Aspect 7)

In any one of Aspects 1 to 6 described above, the paddle may be driven alternately in a first direction parallel to the upper surface of the ionically resistive element and a second direction opposite to the first direction to stir the plating solution.

(Aspect 8)

In Aspect 7 described above, the paddle may have a honeycomb structure including a plurality of stirring members constituting a plurality of polygonal through-holes extending in an upper/lower direction, and the plurality of stirring members may include a polygonal portion having a quadrangle shape, a first projecting portion projecting in an arc-like shape from a side surface on the first direction of the polygonal portion to the first direction, and a second projecting portion projecting in an arc-like shape from a side surface on the second direction of the polygonal portion to the second direction, in a plan view.

With this aspect, since the paddle has a honeycomb structure, an arrangement density of the plurality of stirring members can be easily increased. Accordingly, since the plating solution can be effectively stirred with the paddle, gas bubbles attached to the hole of the ionically resistive element can be effectively removed.

In addition, with this aspect, since the plurality of stirring members of the paddle include the polygonal portion, the first projecting portion, and the second projecting portion, for example, compared with a case where the plurality of stirring members include the polygonal portion but do not include the first projecting portion or the second projecting portion, an area stirrable with the paddle when the paddle moves a constant distance can be easily expanded. Accordingly, since the plating solution can be effectively stirred with the paddle, the gas bubbles attached to the hole of the ionically resistive element can be effectively removed.

(Aspect 9)

In Aspect 8 described above, a paddle width as a maximum value of a distance between the first projecting portion and the second projecting portion may be smaller than a substrate width as a maximum value of a distance between an outer edge in the first direction and an outer edge in the second direction of the surface to be plated of the substrate on which a plating process is performed.

With this aspect, for example, compared with a case where the paddle width is the same as the substrate width or greater than the substrate width, a moving distance in the first direction and the second direction of the paddle can be increased. Accordingly, since the plating solution can be more effectively stirred with the paddle, gas bubbles attached to the hole of the ionically resistive element can be effectively removed.

(Aspect 10)

To achieve the above-described object, a plating apparatus according to one aspect of the present invention includes: a plating tank provided with an anode and an ionically resistive element arranged above the anode and having a plurality of holes; a substrate holder configured to hold a substrate as a cathode; and a paddle arranged above the ionically resistive element and below the substrate, and configured to be driven alternately in a first direction parallel to an upper surface of the ionically resistive element and a second direction opposite to the first direction to stir a plating solution accumulated in the plating tank. The paddle has a honeycomb structure including a plurality of stirring members constituting a plurality of polygonal through-holes extending in an upper/lower direction. The plurality of stirring members include a polygonal portion having a quadrangle shape, a first projecting portion projecting in an arc-like shape from a side surface on the first direction of the polygonal portion to the first direction, and a second projecting portion projecting in an arc-like shape from a side surface on the second direction of the polygonal portion to the second direction, in a plan view.

With this aspect, even in a case where gas bubbles get attached to the hole of the ionically resistive element, the stirring of the plating solution with the paddle can accelerate an upward movement of the gas bubbles attached to the hole. Accordingly, the gas bubbles attached to the hole of the ionically resistive element can be removed.

In addition, with this aspect, since the plurality of stirring members of the paddle constitute a honeycomb structure, and the plurality of stirring members of the paddle include the polygonal portion, the first projecting portion, and the second projecting portion, as described above, the plating solution can be more effectively stirred with the paddle, and the gas bubbles attached to the hole of the ionically resistive element can be effectively removed.

(Aspect 11)

In Aspect 10 described above, a paddle width as a maximum value of a distance between the first projecting portion and the second projecting portion may be smaller than a substrate width as a maximum value of a distance between an outer edge in the first direction and an outer edge in the second direction of the surface to be plated of the substrate on which a plating process is performed.

DESCRIPTION OF EMBODIMENTS

Embodiments

The following describes an embodiment of the present invention with reference to the drawings. Note that the drawings are schematically illustrated to facilitate understanding of features of constituent elements, and dimensional proportions and the like of each constituent element are not necessarily the same as the actual ones. In some drawings, orthogonal coordinates of X-Y-Z are illustrated for reference. Among the orthogonal coordinates, the Z-direction corresponds to an upper side, and the −Z-direction corresponds to a lower side (the direction in which gravity acts).

Figure 1:
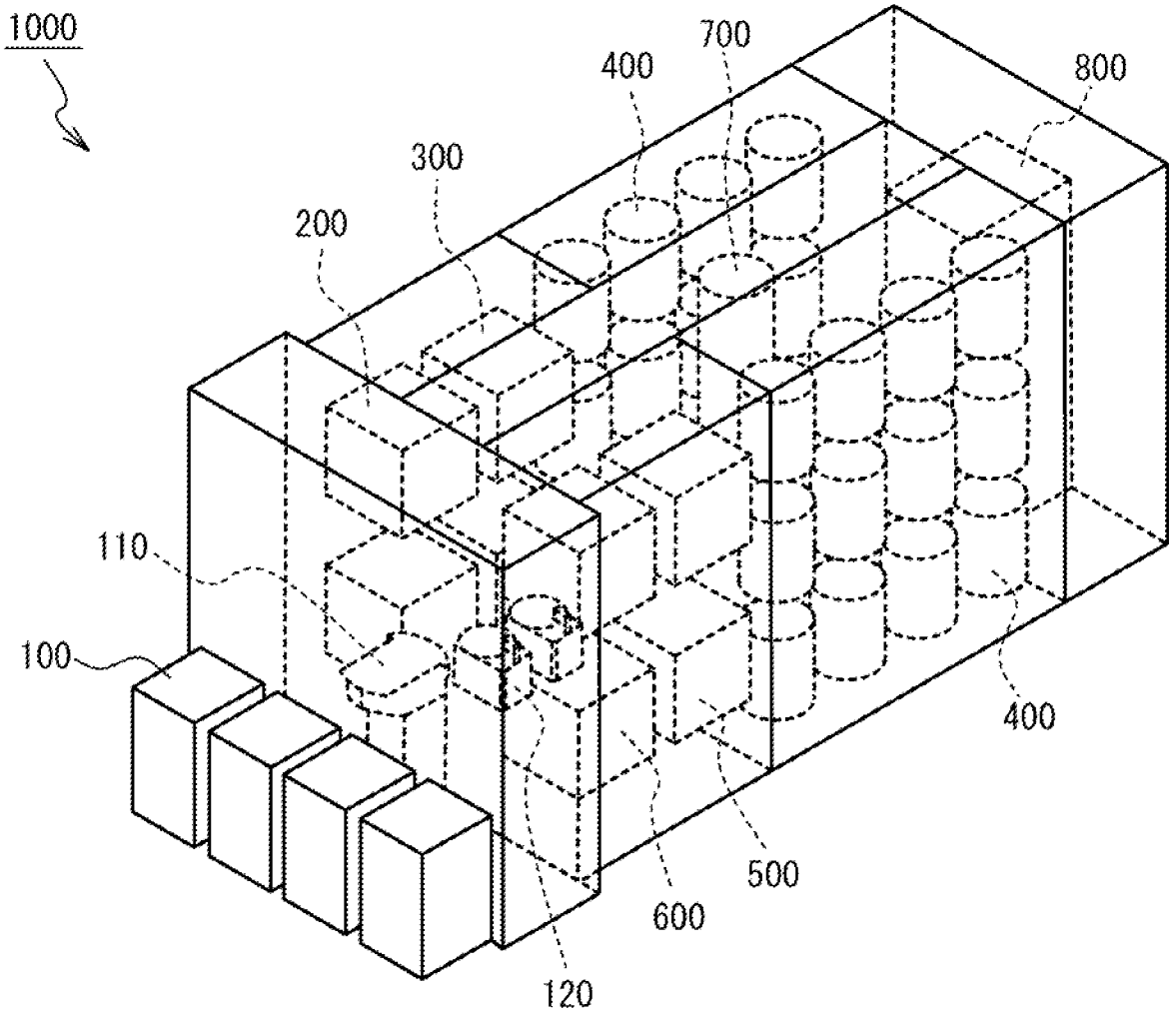
FIG. 1 is a perspective view illustrating an overall configuration of a plating apparatus according to an embodiment.
Figure 2:
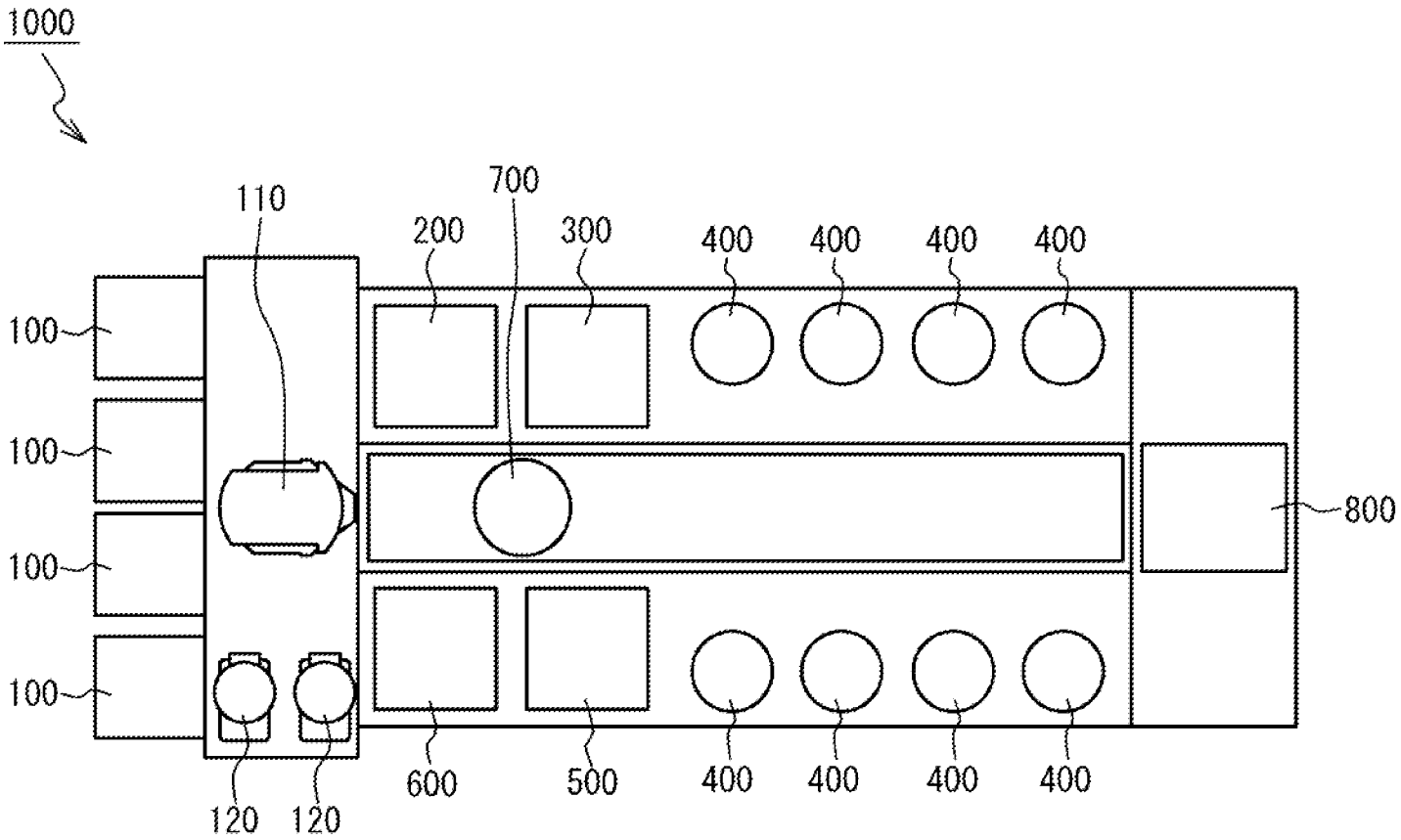
FIG. 2 is a plan view illustrating the overall configuration of the plating apparatus according to the embodiment.

FIG. 1 is a perspective view illustrating the overall configuration of a plating apparatus 1000 of this embodiment. FIG. 2 is a plan view (top surface view) illustrating the overall configuration of the plating apparatus 1000 of this embodiment. As illustrated in FIG. 1 and FIG. 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, the pre-wet module 200, and the spin rinse dryers 600. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the upper/lower direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the upper/lower direction in this embodiment, the number of pre-soak modules 300 and arrangement of the pre-soak modules 300 are arbitrary. The plating module 400 performs the plating process on the substrate. There are two sets of the 12 plating modules 400 arranged by three in the upper/lower direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the upper/lower direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the upper/lower direction in this embodiment, the number of spin rinse dryers 600 and arrangement of the spin rinse dryers 600 are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the pre-wet module 200.

The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer robot 110 receives the substrate from the spin rinse dryer 600 and transfers the substrate, on which the drying process is performed, to the cassette at the load port 100. Finally, the cassette housing the substrate is unloaded from the load port 100.

Note that the configuration of the plating apparatus 1000 described in FIG. 1 and FIG. 2 is merely an example, and the configuration of the plating apparatus 1000 is not limited to the configuration in FIG. 1 or FIG. 2.

Subsequently, the plating modules 400 will be described. Note that, since the plurality of plating modules 400 included in the plating apparatus 1000 according to this embodiment have the identical configuration, one of the plating modules 400 will be described.

Figure 3:
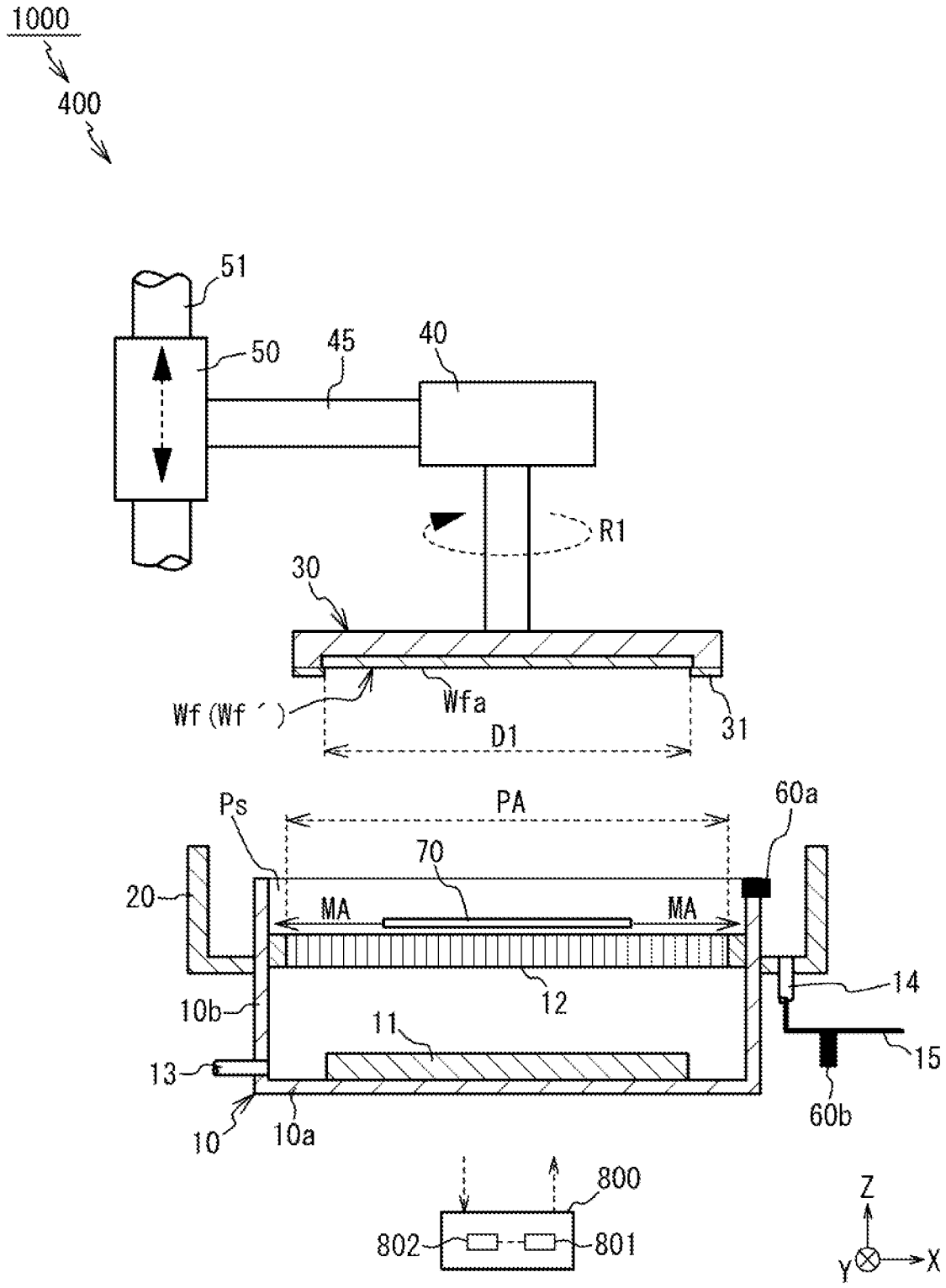
FIG. 3 is a schematic diagram illustrating a configuration of a plating module of the plating apparatus according to the embodiment.
Figure 4:
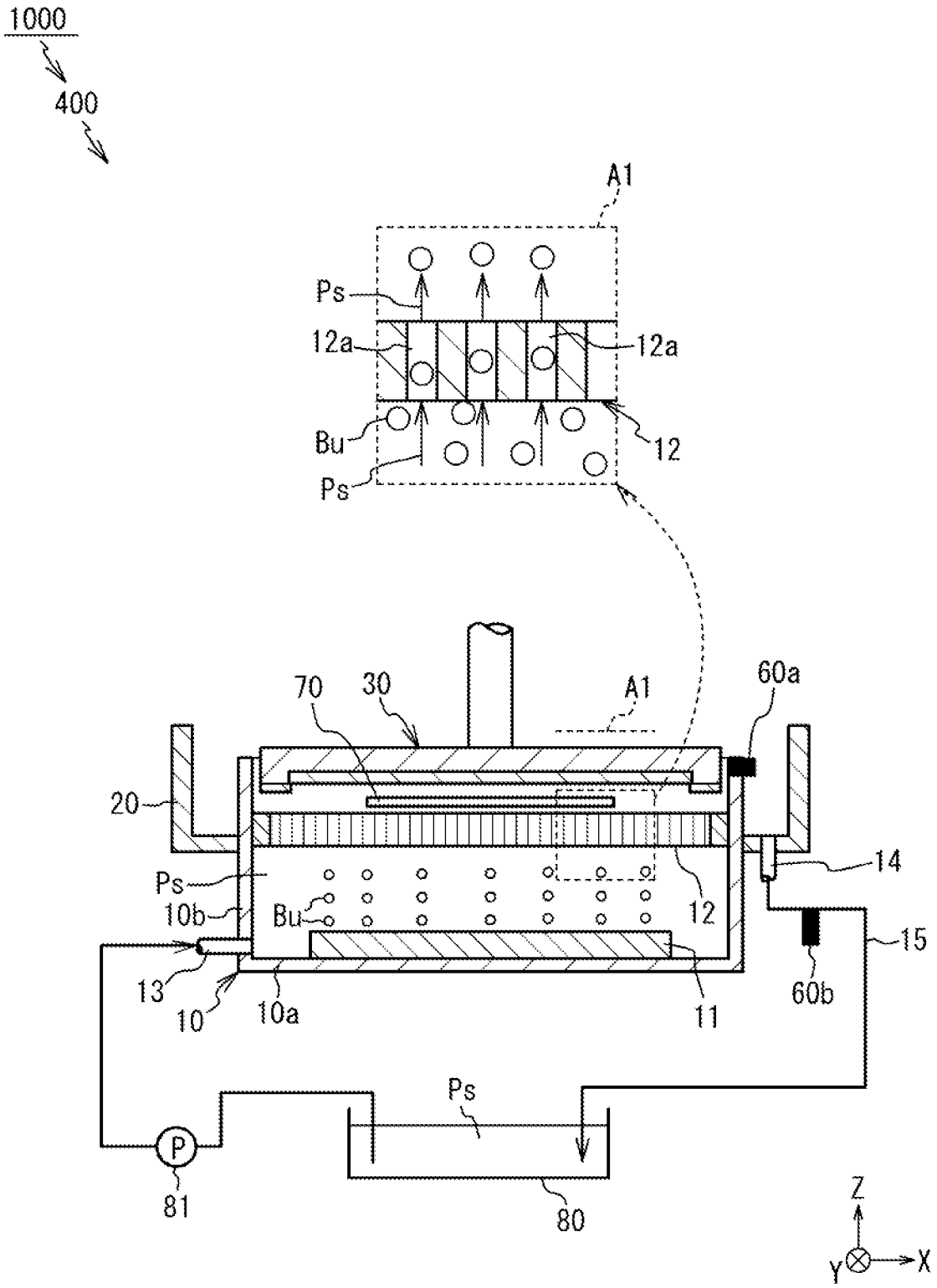
FIG. 4 is a schematic diagram illustrating a state where the substrate according to the embodiment is immersed in a plating solution.

FIG. 3 is a schematic diagram illustrating the configuration of the plating module 400 in the plating apparatus 1000 according to this embodiment. Specifically, FIG. 3 schematically illustrates the plating module 400 in a state before a substrate Wf is immersed in a plating solution Ps. FIG. 4 is a schematic diagram illustrating a state where the substrate Wf is immersed in the plating solution Ps. Note that, a part of FIG. 4 also illustrates an enlarged view of the part A1 but the enlarged view of the part A1 omits an illustration of a paddle 70 described later.

The plating apparatus 1000 according to this embodiment is a cup type plating apparatus. The plating module 400 of the plating apparatus 1000 includes a plating tank 10, an overflow tank 20, a substrate holder 30, and the paddle 70. Furthermore, as illustrated in FIG. 3, the plating module 400 may include a rotation mechanism 40, an inclination mechanism 45, and an elevating mechanism 50.

The plating tank 10 according to this embodiment is configured of a container with a bottom having an opening in an upper side. Specifically, the plating tank 10 has a bottom wall 10*a* and an outer peripheral wall 10*b* extending upward from an outer peripheral edge of the bottom wall 10*a*, and an upper portion of the outer peripheral wall 10*b* is open.

Although the shape of the outer peripheral wall 10*b* of the plating tank 10 is not particularly limited, the outer peripheral wall 10*b* according to this embodiment has a cylindrical shape as an example. In the inside of the plating tank 10, a plating solution Ps is accumulated. The plating tank 10 is provided with a supply port 13 for supplying a plating solution Ps to the plating tank 10.

It is only necessary for the plating solution Ps to be a solution including ions of a metallic element for constituting a plating film, and a specific example of the plating solution Ps is not particularly limited. In this embodiment, a copper plating process is used as an example of the plating process, and a copper sulfate solution is used as an example of the plating solution Ps. The plating solution Ps may include a predetermined additive.

In the inside of the plating tank 10, an anode 11 is arranged. A specific type of the anode 11 is not particularly limited, and it may be an insoluble anode or may be a soluble anode. In this embodiment, an insoluble anode is used as an example of the anode 11. A specific type of the insoluble anode is not particularly limited, and platinum, iridium oxide, and the like can be used.

In the inside of the plating tank 10, above the anode 11, an ionically resistive element 12 is arranged. Specifically, as illustrated in FIG. 4 (enlarged view of part A1), the ionically resistive element 12 is configured of a porous plate member having a plurality of holes 12*a* (pores). The holes 12*a* are disposed so as to communicate with a lower surface and a top surface of the ionically resistive element 12. As illustrated in FIG. 3, a region in which the plurality of holes 12*a* are formed in the ionically resistive element 12 is referred to as a "hole-formed area PA." The hole-formed area PA according to this embodiment has a circular shape in a plan view. The hole-formed area PA according to this embodiment has an area that is the same as an area of a surface to be plated Wfa of the substrate Wf or greater than the area of the surface to be plated Wfa. However, it is not limited to this configuration, and the hole-formed area PA may have an area that is smaller than the area of the surface to be plated Wfa of the substrate Wf.

The ionically resistive element 12 is disposed to ensure homogenization of an electric field formed between the anode 11 and the substrate Wf as a cathode (the reference numeral is denoted in FIG. 6 described below). By the ionically resistive element 12 being arranged in the plating tank 10, as in this embodiment, the uniformization of film thickness of the plating film (plated layer) formed on the substrate Wf can be easily ensured.

The overflow tank 20 is configured of a container with a bottom arranged outside the plating tank 10. The overflow tank 20 is disposed for temporarily accumulating a plating solution Ps that has exceeded an upper end of the outer periphery wall 10*b* of the plating tank 10 (that is, the plating solution Ps overflowed from the plating tank 10). The plating solution Ps accumulated in the overflow tank 20 is discharged from a discharge port 14, subsequently passes through a flow passage 15, and is temporarily accumulated in a reservoir tank 80 (see FIG. 4). The plating solution Ps accumulated in the reservoir tank 80 is subsequently pressure fed by a pump 81 (see FIG. 4), and circulated into the plating tank 10 again from the supply port 13.

The plating module 400 may include a level sensor 60*a* for detecting a position of a liquid surface of a plating solution Ps in the plating tank 10. A detection result of the level sensor 60*a* is transmitted to the control module 800.

The plating module 400 may include a flow rate sensor 60*b* for detecting a flow rate (L/min) of the plating solution Ps that has overflowed from the plating tank 10. A detection result of the flow rate sensor 60*b* is transmitted to the control module 800. Although a specific arrangement position of the flow rate sensor 60*b* is not particularly limited, the flow rate sensor 60*b* according to this embodiment is arranged in the flow passage 15 communicating with the discharge port 14 of the overflow tank 20 and the reservoir tank 80 as an example.

The substrate holder 30 holds the substrate Wf as a cathode such that a surface to be plated Wfa of the substrate Wf is opposed to the anode 11. In this embodiment, specifically, the surface to be plated Wfa of the substrate Wf is disposed on a surface facing a lower side (lower surface) of the substrate Wf.

As illustrated in FIG. 3, the substrate holder 30 may include a ring 31 disposed so as to project below an outer peripheral edge of the surface to be plated Wfa of the substrate Wf. Specifically, the ring 31 according to this embodiment has a ring shape in a lower surface view.

The substrate holder 30 is connected to the rotation mechanism 40. The rotation mechanism 40 is a mechanism for rotating the substrate holder 30. "R1" denoted in FIG. 3 is an exemplary rotation direction of the substrate holder 30. As the rotation mechanism 40, a known rotation motor and the like can be used. The inclination mechanism 45 is a mechanism for inclining the rotation mechanism 40 and the substrate holder 30. The elevating mechanism 50 is supported by a spindle 51 extending in an upper/lower direction. The elevating mechanism 50 is a mechanism for moving up and down the substrate holder 30, the rotation mechanism 40 and the inclination mechanism 45. As the elevating mechanism 50, a known elevating mechanism, such as a linear motion type actuator, can be used.

Figure 12:
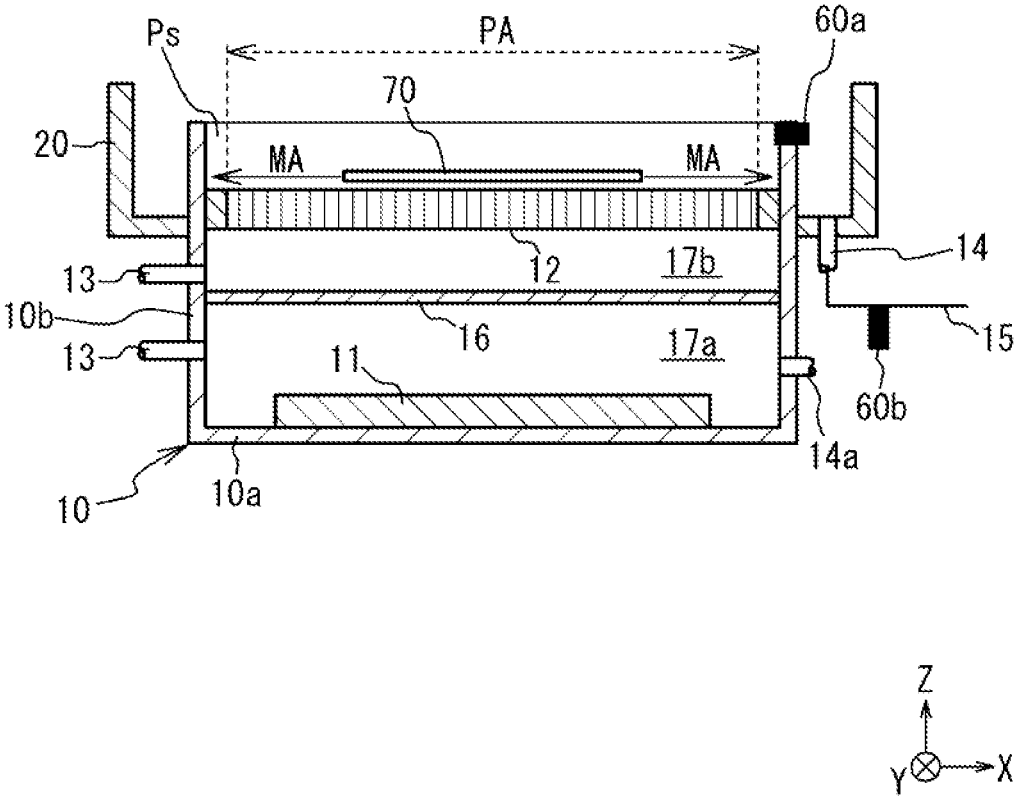
FIG. 12 is a schematic cross-sectional view illustrating an exemplary internal configuration of a plating tank in a case where a membrane is arranged inside the plating tank according to the embodiment.

Note that, as illustrated in FIG. 12, in the inside of the plating tank 10, at a position above the anode 11 and below the ionically resistive element 12, a membrane 16 may be arranged. In this case, the inside of the plating tank 10 is partitioned by the membrane 16 into an anode chamber 17*a* below the membrane 16 and a cathode chamber 17*b* above the membrane 16. The anode 11 is arranged in the anode chamber 17*a*, and the ionically resistive element 12 is arranged in the cathode chamber 17*b*. The membrane 16 is configured to allow ion species including metal ions included in the plating solution Ps to pass through the membrane 16, while inhibiting nonionic plating additives included in the plating solution Ps from passing through the membrane 16. As the membrane 16, an ion exchange membrane can be used as an example.

In a case where the inside of the plating tank 10 is partitioned by the membrane 16 into the anode chamber 17*a* and the cathode chamber 17*b*, the supply port 13 is preferred to be disposed in both the anode chamber 17*a* and the cathode chamber 17*b*. The anode chamber 17*a* is preferred to be provided with a discharge port 14*a* for discharging the plating solution Ps in the anode chamber 17*a*.

Figure 5:
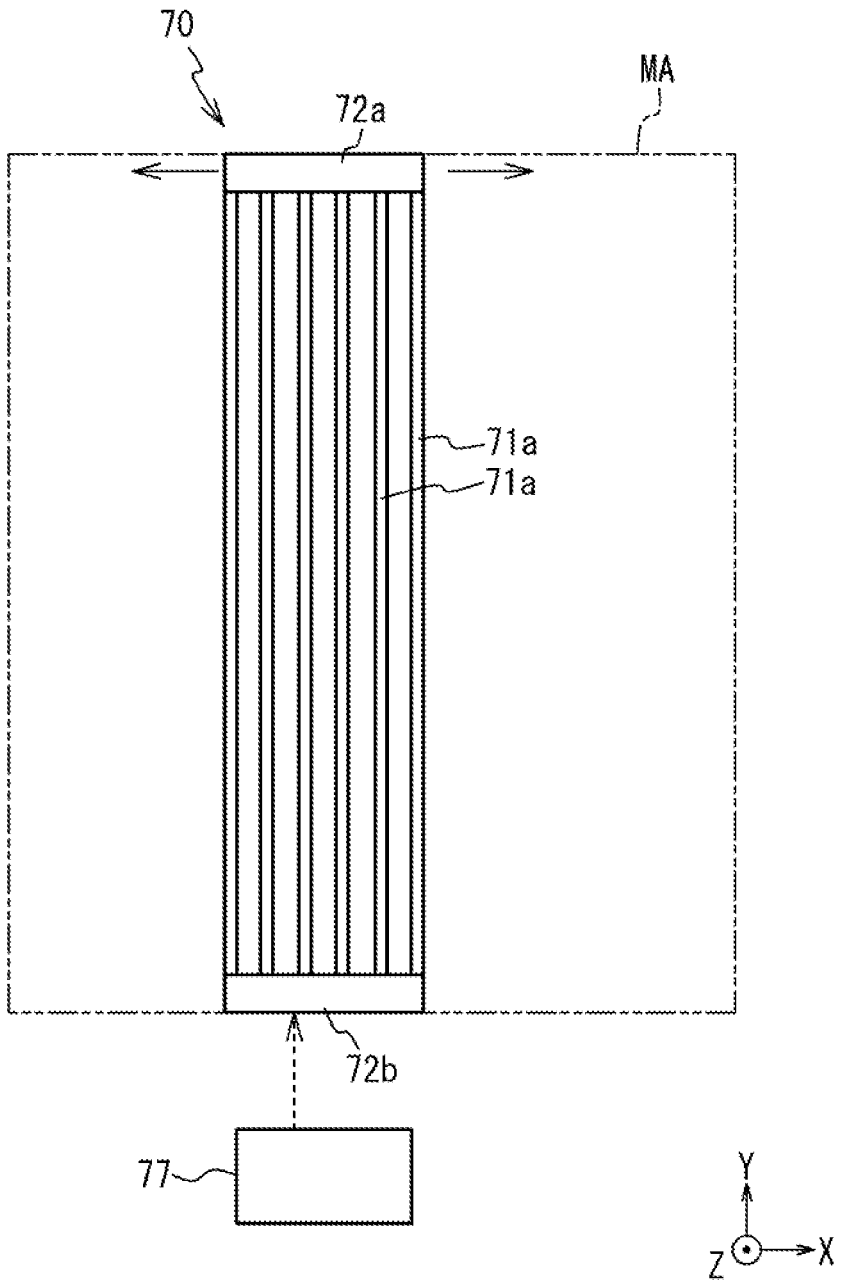
FIG. 5 is a schematic plan view of a paddle according to the embodiment.

FIG. 5 is a schematic plan view of the paddle 70. With reference to FIG. 3, FIG. 4, and FIG. 5, the paddle 70 is arranged in a position above the ionically resistive element 12 and below the substrate Wf. The paddle 70 is driven by a driving device 77. By the paddle 70 being driven, the plating solution Ps in the plating tank 10 is stirred.

The paddle 70 according to this embodiment is, as an example, driven alternately in a "first direction (X-direction, as an example, in this embodiment)" parallel to an upper surface of the ionically resistive element 12 and a "second direction (−X-direction, as an example, in this embodiment)" opposite to the first direction. That is, the paddle 70 according to this embodiment is, for example, reciprocated in the X-axis direction. The driving operation of the paddle 70 is controlled by the control module 800.

As illustrated in FIG. 5, the paddle 70 according to this embodiment, as an example, includes a plurality of stirring members 71*a* extending in a direction perpendicular to the first direction and the second direction (Y-axis direction) of the paddle 70. Between adjacent stirring members 71*a*, a clearance is provided. One ends of the plurality of stirring members 71*a* are coupled to a coupling member 72*a*, and other ends are coupled to a coupling member 72*b*.

The paddle 70 is preferred to be configured such that a moving region MA of the paddle 70 (that is, a range in which the paddle 70 reciprocates) when stirring the plating solution Ps covers an entire hole-formed area PA of the ionically resistive element 12 in a plan view. With this configuration, the plating solution Ps above the hole-formed area PA of the ionically resistive element 12 can be effectively stirred with the paddle 70.

Note that, it is only necessary that the paddle 70 is arranged inside the plating tank 10 at least when stirring the plating solution Ps, and need not be arranged inside the plating tank 10 constantly. For example, in a case where the driving of the paddle 70 is stopped and the stirring of the plating solution Ps with the paddle 70 is not performed, a configuration in which the paddle 70 is not arranged inside the plating tank 10 is allowed.

The control module 800 includes a microcomputer, which includes a CPU (Central Processing Unit) 801 as a processor, a storage device 802 as a non-transitory storage medium, and the like. By the CPU 801 operating as the processor based on commands of a program stored in the storage device 802, the control module 800 controls the operation of the plating module 400.

In some cases, gas bubbles Bu generate in the plating solution Ps in the plating tank 10. Specifically, for example, when supplying the plating solution Ps to the plating tank 10, in a case where air flows into the plating tank 10 together with the plating solution Ps, the air may possibly become the gas bubbles Bu.

As described above, in a case where the gas bubbles Bu generate in the plating solution Ps in the plating tank 10, the gas bubbles Bu get attached to the holes 12*a* of the ionically resistive element 12 in some cases. In a hypothetical case where the plating process is performed on the substrate Wf in a state where a large amount of the gas bubbles Bu are attached to the holes 12*a*, the gas bubbles Bu may possibly cause the plating quality of the substrate Wf to deteriorate. Therefore, in this embodiment, a technique described below is used to deal with this problem.

Figure 6:
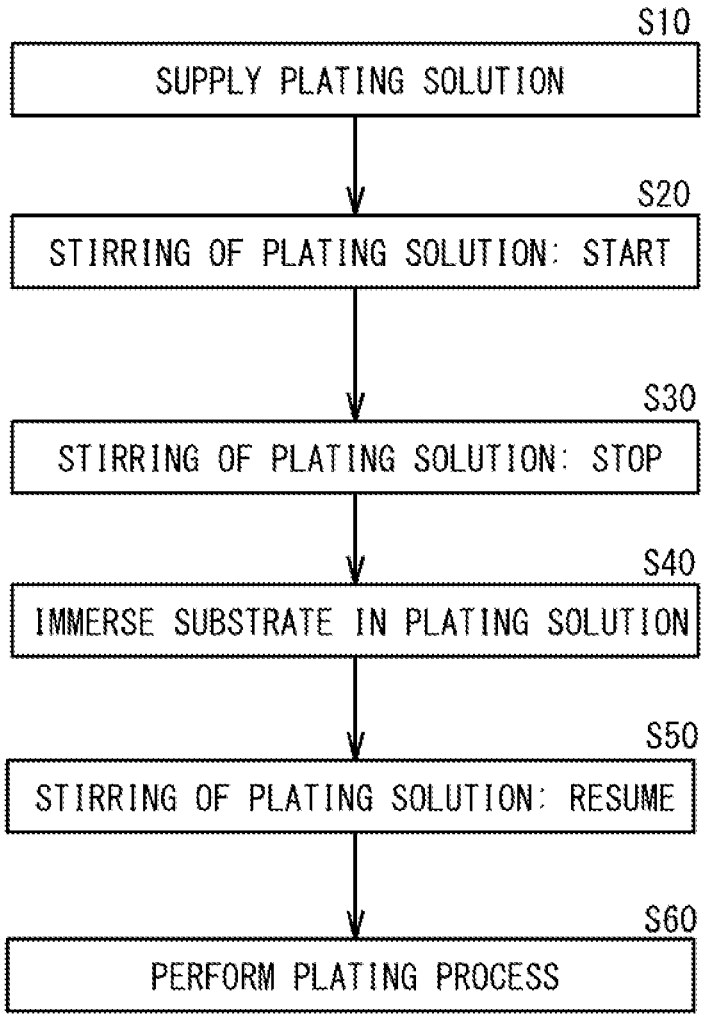
FIG. 6 is an exemplary flowchart for describing a plating method according to the embodiment.

FIG. 6 is an exemplary flowchart for describing a plating method according to this embodiment. The plating method according to this embodiment includes step S10 to step S60. Note that, the plating method according to this embodiment may be executed automatically by the control module 800. Furthermore, before step S10 according to this embodiment is executed, the plating solution Ps is assumed not to be accumulated inside the plating tank 10. Alternatively, even in a case where the plating solution Ps is accumulated inside the plating tank 10, the liquid surface of the plating solution Ps of the plating tank 10 is positioned below the ionically resistive element 12.

In step S10, by supplying the plating solution Ps to the plating tank 10, the anode 11 and the ionically resistive element 12 are immersed in the plating solution Ps. Specifically, in this embodiment, by supplying the plating solution Ps from the supply port 13 to the plating tank 10, the anode 11 and the ionically resistive element 12 are immersed in the plating solution Ps.

Note that, in step S10, the position of the liquid surface of the plating solution Ps may be obtained based on the detection result of the above-described level sensor 60*a*, and the plating solution Ps may be supplied to the plating tank 10 until the obtained position of the liquid surface of the plating solution Ps is determined to be a predetermined position above the anode 11 and the ionically resistive element 12.

Alternatively, in step S10, the flow rate of the plating solution Ps overflowed from the plating tank 10 may be obtained based on the detection result of the above-described flow rate sensor 60*b*, and the plating solution Ps may be supplied to the plating tank 10 until the obtained flow rate is determined to be greater than zero. Even in this case, the liquid surface of the plating solution Ps in the plating tank 10 can be positioned above the anode 11 and the ionically resistive element 12, and thereby immerse the anode 11 and the ionically resistive element 12 in the plating solution Ps.

After step S10, step S20 is performed. Specifically, step S20 is performed after the plating solution Ps is started to be supplied to the plating tank 10 according to step S10 and in a case where the liquid surface of the plating solution Ps of the plating tank 10 is at a position where the plating solution Ps can be stirred with the paddle 70 (such as in a case where the liquid surface of the plating solution Ps is positioned above the paddle 70).

In step S20, by driving the paddle 70 arranged above the ionically resistive element 12 and below the substrate Wf, the plating solution Ps is stirred with the paddle 70. That is, in step S20, the stirring of the plating solution Ps with the paddle 70 is started. Specifically, in this embodiment, the plating solution Ps is stirred by driving the paddle 70 alternately in the first direction and the second direction.

With this embodiment, for example, even in a case where the gas bubbles Bu included in the plating solution Ps get attached to the holes 12*a* of the ionically resistive element 12 when supplying the plating solution Ps to the plating tank 10, by stirring the plating solution Ps with the paddle 70 according to step S20, an upward movement of the gas bubbles Bu can be accelerated. Accordingly, the gas bubbles Bu attached to the holes 12*a* of the ionically resistive element 12 can be removed.

Note that, the flow rate (L/min) of the plating solution Ps flowing from a lower surface side of the ionically resistive element 12, passing through the plurality of holes 12*a*, and flowing toward an upper surface side of the ionically resistive element 12 is preferred to be large, in that the gas bubbles Bu attached to the holes 12*a* of the ionically resistive element 12 can be effectively removed.

Therefore, for example, it is preferred to make the flow rate of the plating solution Ps flowing from the lower surface side of the ionically resistive element 12, passing through the plurality of holes 12*a*, and flowing toward the upper surface side of the ionically resistive element 12 in step S20 greater than the flow rate of the plating solution Ps flowing from the lower surface side of the ionically resistive element 12, passing through the plurality of holes 12*a*, and flowing toward the upper surface side of the ionically resistive element 12 in step S60 described later. With this configuration, the gas bubbles Bu attached to the holes 12*a* of the ionically resistive element 12 can be effectively removed.

Note that, for example, by increasing a rotational speed of the pump 81 (which is a pump for pressure feeding the plating solution Ps in the reservoir tank 80 toward the plating tank 10), a circulating flow rate of the plating solution Ps circulating between the reservoir tank 80 and the plating tank 10 can be increased. Accordingly, the flow rate of the plating solution Ps flowing inside the plating tank 10 can be increased and thus the flow rate of the plating solution Ps flowing from the lower surface side of the ionically resistive element 12, passing through the plurality of holes 12*a*, and flowing toward the upper surface side of the ionically resistive element 12 can be increased.

That is, in this embodiment, the circulating flow rate (L/min) of the plating solution Ps in step S20 is preferred to be greater than a circulating flow rate of the plating solution Ps in step S60 (referred to as a "reference flow rate (L/min)"). Accordingly, the flow rate of the plating solution Ps flowing from the lower surface side of the ionically resistive element 12, passing through the plurality of holes 12*a*, and flowing toward the upper surface side of the ionically resistive element 12 in step S20 becomes greater than the flow rate of the plating solution Ps flowing from the lower surface side of the ionically resistive element 12, passing through the plurality of holes 12*a*, and flowing toward the upper surface side of the ionically resistive element 12 in step S60. As a result, the gas bubbles Bu attached to the holes 12*a* of the ionically resistive element 12 can be effectively removed.

After step S20, step S30 is performed. In step S30, the driving of the paddle 70 is stopped and the stirring of the plating solution Ps with the paddle 70 is stopped.

Note that, although a specific example of a time period from when the stirring with the paddle 70 is started in step S20 to when the stirring with the paddle 70 is stopped in step S30 (that is, a stirring time period of the paddle 70) is not particularly limited, for example, a predetermined time period selected from two seconds or more to ten seconds or less can be used. Thus, with this embodiment, just by stirring the plating solution Ps with the paddle 70 for a short period, the gas bubbles Bu attached to the holes 12*a* of the ionically resistive element 12 can be removed.

After step S30, step S40 is performed. In step S40, the substrate Wf is immersed in the plating solution Ps in a state where the stirring of the plating solution Ps with the paddle 70 is stopped. Specifically, in this embodiment, by the elevating mechanism 50 moving down the substrate holder 30, at least the surface to be plated Wfa of the substrate Wf is immersed in the plating solution Ps.

As in this embodiment, since the substrate Wf is immersed in the plating solution Ps in step S40 in a state where the stirring of the plating solution Ps with the paddle 70 has been stopped in step S30, waves generating on the liquid surface of the plating solution Ps caused by the stirring of the plating solution Ps with the paddle 70 when the substrate Wf is immersed in the plating solution Ps can be suppressed. Accordingly, a large amount of the gas bubbles Bu getting attached to the surface to be plated Wfa of the substrate Wf when the substrate Wf is immersed in the plating solution Ps can be suppressed.

Note that, in step S40, the surface to be plated Wfa of the substrate Wf may be brought into contact with the plating solution Ps in a state where the substrate holder 30 is inclined such that the surface to be plated Wfa of the substrate Wf is inclined with respect to the horizontal direction by the inclination mechanism 45 (that is, such that the surface to be plated Wfa is inclined with respect to the horizontal surface). With this configuration, compared with a case where the surface to be plated Wfa of the substrate Wf is brought into contact with the plating solution Ps in a state where the surface to be plated Wfa is in the horizontal direction, the gas bubbles Bu getting attached to the surface to be plated Wfa can be effectively suppressed.

After step S40, step S50 is performed. In step S50, the stirring of the plating solution Ps with the paddle 70 is resumed in a state where the substrate Wf is immersed in the plating solution Ps. Specifically, in this embodiment, the stirring of the plating solution Ps with the paddle 70 is resumed by driving the paddle 70 arranged above the ionically resistive element 12 and below the substrate Wf alternately in the first direction and the second direction in a state where the substrate Wf is immersed in the plating solution Ps.

Thus, by the stirring of the plating solution Ps with the paddle 70 being resumed in a state where the plating solution Ps is immersed in the substrate Wf, the plating solution Ps can be effectively supplied onto the surface to be plated Wfa of the substrate Wf. Accordingly, for example, a pre-wet process liquid remaining inside a wiring pattern of the surface to be plated Wfa of the substrate Wf can be effectively replaced with the plating solution Ps.

Furthermore, as described above, in step S40, in a case where the surface to be plated Wfa of the substrate Wf is brought into contact with the plating solution Ps in a state where the surface to be plated Wfa is inclined, the stirring of the plating solution Ps with the paddle 70 according to step S50 is preferred to be resumed after the surface to be plated Wfa of the substrate Wf in a state of being immersed in the plating solution Ps is returned to the horizontal direction. That is, in this case, the surface to be plated Wfa of the substrate Wf is brought into contact with the plating solution Ps in a state where the surface to be plated Wfa is inclined in step S40, then the surface to be plated Wfa of the substrate Wf is returned to the horizontal direction (which is referred to as "step S45"), and then the stirring of the plating solution Ps with the paddle 70 according to step S50 is started.

In a hypothetical case where the stirring of the plating solution Ps with the paddle 70 is resumed in a state where the surface to be plated Wfa of the substrate Wf is inclined in the horizontal direction, since an upper end of the surface to be plated Wfa (upper end of an outer edge of the surface to be plated Wfa) of the substrate Wf in an inclined state becomes close to the liquid surface of the plating solution Ps, when waves generate on the liquid surface of the plating solution Ps by the stirring of the plating solution Ps with the paddle 70 being resumed, the gas bubbles Bu may possibly become easier to be drawn to the surface to be plated Wfa of the substrate Wf. In contrast to this, with this configuration, since the stirring of the plating solution Ps with the paddle 70 is resumed after the surface to be plated Wfa of the substrate Wf in a state of being immersed in the plating solution Ps is returned to the horizontal direction, even in a hypothetical case where waves generate on the liquid surface of the plating solution Ps by the stirring of the plating solution Ps with the paddle 70 being resumed, the gas bubbles Bu being drawn to the surface to be plated Wfa of the substrate Wf can be effectively suppressed.

After step S50, step S60 is performed. In step S60, the plating process is performed on the surface to be plated Wfa of the substrate Wf by flowing electricity between the substrate Wf and the anode 11 in a state where the stirring of the plating solution Ps with the paddle 70 is resumed (that is, in a state where the plating solution Ps is being stirred with the paddle 70). Accordingly, a plating film made of gold is formed on the surface to be plated Wfa.

As in step S60, by the stirring of the plating solution Ps with the paddle 70 being performed during the plating process on the substrate Wf, the plating solution Ps can be effectively supplied onto the surface to be plated Wfa of the substrate Wf during the plating process. Accordingly, a plating film can be effectively formed on the substrate Wf.

Note that, the plating process on the substrate Wf according to step S60 may be started simultaneously with the resuming of the stirring of the plating solution Ps with the paddle 70 according to step S50. Alternatively, the plating process on the substrate Wf according to step S60 may be started after a predetermined time period passes since the stirring of the plating solution Ps has been resumed according to step S50. Although a specific value of the predetermined time period is not particularly limited, for example, it is preferred that a sufficient time period is spent for allowing the plating solution Ps to reach throughout vias, through-holes, and the like of a wiring pattern formed on the surface to be plated Wfa of the substrate Wf. As an exemplary predetermined time period, for example, a time period selected from 30 seconds or more to 60 seconds or less can be used.

Note that, in step S60, the rotation mechanism 40 may rotate the substrate holder 30. Furthermore, in step S60, the inclination mechanism 45 may incline the substrate holder 30 such that the surface to be plated Wfa of the substrate Wf is inclined with respect to the horizontal direction.

Furthermore, a reciprocating movement speed of the paddle 70 in step S20 (first reciprocating movement speed) and a reciprocating movement speed of the paddle 70 in step S50 and step S60 (second reciprocating movement speed) may have the same values or different values. In a case where the reciprocating movement speed of the paddle 70 in step S20 and the reciprocating movement speed of the paddle 70 in step S50 and step S60 are different, the reciprocating movement speed in step S20 may be faster or slower than the reciprocating movement speed in step S50 and/or step S60.

However, the faster the reciprocating movement speed of the paddle 70 is, the higher a removal effect of the gas bubbles Bu tends to become. Furthermore, generally, the amount of gas bubbles Bu attached to the holes 12*a* of the ionically resistive element 12 is considered to be larger before the start of performing step S20 than before the start of performing step S50. Therefore, in terms of effectively removing the gas bubbles Bu attached to the holes 12*a* of the ionically resistive element 12, the movement speed of the paddle 70 in step S20 is preferred to be faster than the reciprocating movement speed of the paddle 70 in step S50 and step S60.

Although specific values of the reciprocating movement speed of the paddle 70 in step S20, step S50, and step S60 are not particularly limited, as an example, values selected from a range of 25 (rpm) or more to 400 (rpm) or less can be used, specifically, values selected from a range of 100 (rpm) or more to 300 (rpm) or less can be used, and more specifically, values selected from a range of 150 (rpm) or more to 250 (rpm) or less can be used. Here, "the reciprocating movement speed of the paddle 70 is N (rpm)" specifically means that the paddle 70 performs one reciprocation (that is, the paddle 70 departing from a predetermined position and, for example, moving in the first direction, then the second direction, then moving in the first direction again and returning to the predetermined position) N times per minute.

Note that, the process according to FIG. 6 may be performed, for example, when supplying a new plating solution Ps (unused plating solution) to the plating tank 10 during maintenance of the plating apparatus 1000. Alternatively, the process according to FIG. 6 may be performed, for example, when replenishing the plating tank 10 with the plating solution Ps due to a storage amount of the plating solution Ps in the plating tank 10 decreasing by some sort of cause and the liquid surface of the plating solution Ps being positioned below the ionically resistive element 12 during operation of the plating apparatus 1000.

With this embodiment as described above, the gas bubbles Bu attached to the holes 12*a* of the ionically resistive element 12 can be removed. Accordingly, the attached gas bubbles Bu causing the plating quality of the substrate Wf to deteriorate can be suppressed.

(Modification 1)

Figure 7:
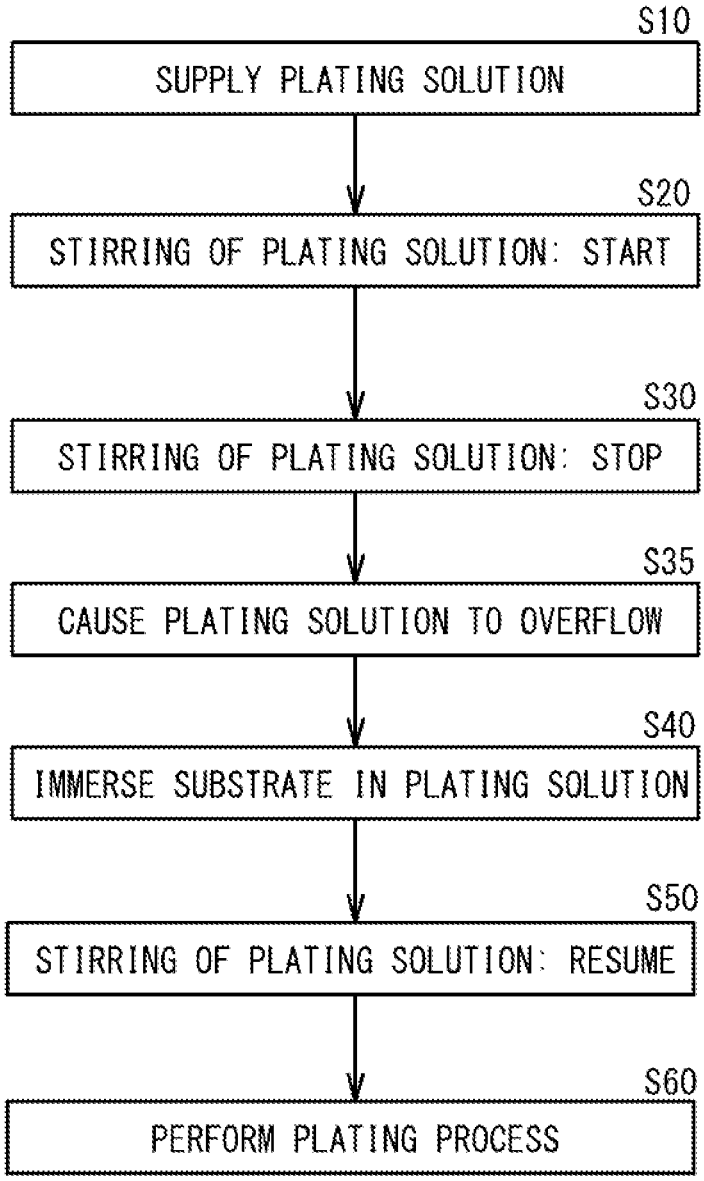
FIG. 7 is an exemplary flowchart for describing a plating method according to Modification 1 of the embodiment.

FIG. 7 is an exemplary flowchart for describing a plating method according to Modification 1 of the embodiment. The plating method according to this modification as illustrated in FIG. 7 is unlike the plating method described in FIG. 6 in that step S35 is further included between step S30 and step S40.

In step S35, the plating solution Ps is caused to overflow from the plating tank 10 in a state where the stirring of the plating solution Ps with the paddle 70 is stopped.

Specifically, in this modification, the plating solution Ps is caused to overflow from the plating tank 10 by supplying the plating solution Ps from the supply port 13. The plating solution Ps overflowed from the plating tank 10 flows into the overflow tank 20. Note that, it is only necessary for step S35 to be performed for a predetermined time period set in advance. Although a specific example of this predetermined time period is not particularly limited, for example, a time period selected from two seconds or more to 120 seconds or less can be used.

According to this modification, since step S35 is performed, the gas bubbles Bu floating above the ionically resistive element 12 can be discharged outside the plating tank 10 together with the plating solution Ps that overflows from the plating tank 10. Accordingly, the gas bubbles Bu getting attached to the substrate Wf when the substrate Wf is immersed in the plating solution Ps in step S40 can be effectively suppressed.

Note that, the flow rate of the plating solution Ps supplied to the plating tank 10 in step S35 may be greater than, lower than, or equal to a "reference flow rate (Imin)" that is a flow rate of the plating solution Ps supplied to the plating tank 10 while performing the plating process according to step S60.

However, a case where the flow rate of the plating solution Ps supplied to the plating tank 10 in step S35 is greater than the reference flow rate is preferred compared with a case where the flow rate of the plating solution Ps supplied to the plating tank 10 in step S35 is not greater than the reference flow rate in that the gas bubbles Bu of the plating solution Ps in the plating tank 10 can be promptly discharged outside of the plating tank 10 in step S35.

(Modification 2)

Figure 8:
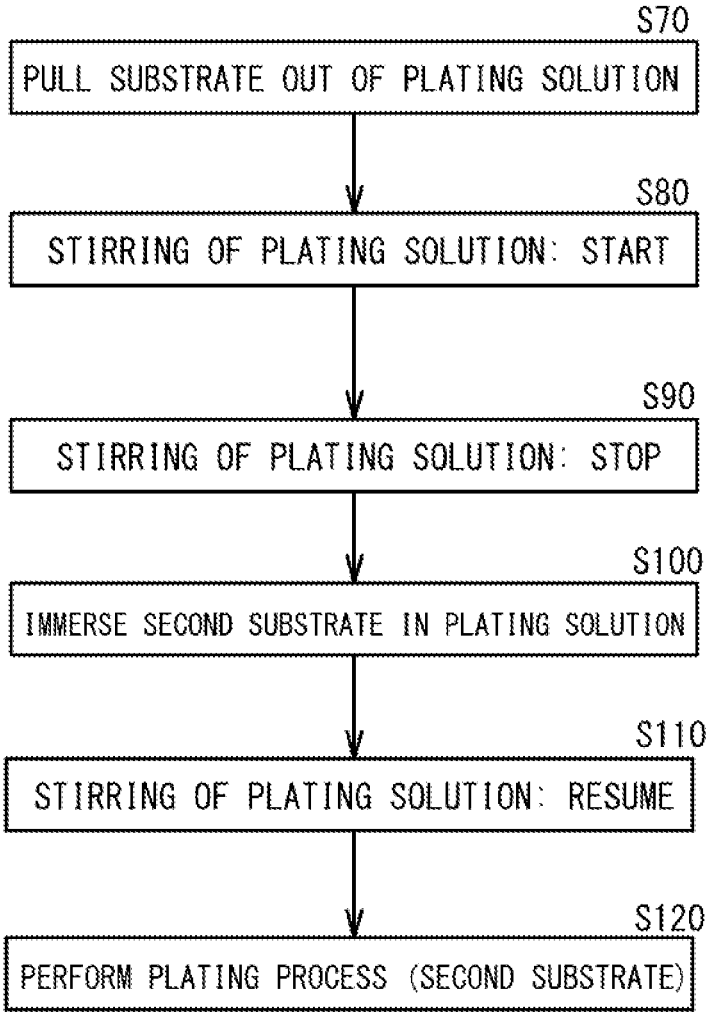
FIG. 8 is an exemplary flowchart for describing a plating method according to Modification 2 of the embodiment.

FIG. 8 is an exemplary flowchart for describing a plating method according to Modification 2 of the embodiment. The process in FIG. 8 is performed after performing step S60 in FIG. 6 described above. The plating method according to this modification is unlike the plating method described above in FIG. 6 in that, after step S60 is performed, step S70, step S80, step S90, step S100, step S110 and step S120 are further performed.

In step S70, after the plating process is performed on the substrate Wf, the substrate Wf is pulled out of the plating solution Ps. Specifically, in this modification, the substrate holder 30 is moved upward by the elevating mechanism 50 and the substrate Wf is pulled out of the plating solution Ps.

Next, in step S80, in a state where the substrate Wf is pulled out of the plating solution Ps, the paddle 70 arranged above the ionically resistive element 12 is driven to stir the plating solution Ps. Note that, since the driving aspect of the paddle 70 according to step S80 is similar to the driving aspect of the paddle 70 according to step S20 described above, a detailed description of step S80 will be omitted.

With this modification, in a state before a second substrate Wf described later is immersed in the plating solution Ps, even in a hypothetical case where the gas bubbles Bu included in the plating solution Ps are attached to the holes 12*a* of the ionically resistive element 12, the stirring of the plating solution Ps with the paddle 70 according to step S80 can accelerate the upward movement of the gas bubbles Bu. Accordingly, the gas bubbles Bu attached to the holes 12*a* of the ionically resistive element 12 can be remove.

Next, in step S90, the stirring of the plating solution Ps with the paddle 70 is stopped. Next, in step S100, the "second substrate Wf" is immersed in the plating solution Ps in a state where the stirring of the plating solution Ps with the paddle 70 is stopped. Note that, the second substrate Wf is a substrate on which the plating process is performed after the plating process has been performed on the substrate Wf in step S60. In this modification, a specific configuration of the second substrate Wf is similar to that of the substrate Wf. Furthermore, step S100 is similar to step S40 described above other than the point of using the second substrate Wf instead of the substrate Wf. Therefore, a detailed description of step S100 will be omitted.

According to this modification, since the second substrate Wf is immersed in the plating solution Ps in a state where the stirring of the plating solution Ps with the paddle 70 is stopped in step S100, waves generating on the liquid surface of the plating solution Ps when the second substrate Wf is immersed in the plating solution Ps can be suppressed. Accordingly, a large amount of the gas bubbles Bu getting attached to a surface to be plated Wfa of the second substrate Wf can be suppressed.

Next, in step S110, the stirring of the plating solution Ps with the paddle 70 is resumed in a state where the second substrate Wf is immersed in the plating solution Ps. Specifically, the stirring of the plating solution Ps with the paddle 70 is resumed by driving the paddle 70 arranged above the ionically resistive element 12 and below the second substrate Wf alternately in the first direction and the second direction. Note that, the step S110 is similar to step S50 described above other than the point of using the second substrate Wf instead of the substrate Wf. Therefore, a detailed description of step S110 will be omitted.

Next, in step S120, by flowing electricity between the second substrate Wf and the anode 11 in a state where the stirring of the plating solution Ps with the paddle 70 has been resumed, the plating process is performed on the surface to be plated Wfa of the second substrate Wf. Accordingly, a plating film made of gold is formed on the surface to be plated Wfa of the second substrate W. Note that, step S120 is similar to step S60 described above other than the point of using the second substrate Wf instead of the substrate Wf. Therefore, a detailed description of step S120 will be omitted. As in step S120, by the stirring of the plating solution Ps with the paddle 70 being performed during the plating process of the second substrate Wf, the plating solution Ps can be effectively supplied to the surface to be plated Wfa of the second substrate Wf during the plating process. Accordingly, a plating film can be effectively formed on the second substrate Wf.

Note that, in a case where the plating process is performed on a third substrate after the plating process is performed on the second substrate Wf' it is only necessary to perform a process similar to the process in FIG. 8 again on the third substrate.

Furthermore, in this modification, step S35 in FIG. 7 described above may be performed between step S90 and step S100. In this case, an operational advantage according to Modification 1 described above can be further provided.

(Modification 3)

Figure 9:
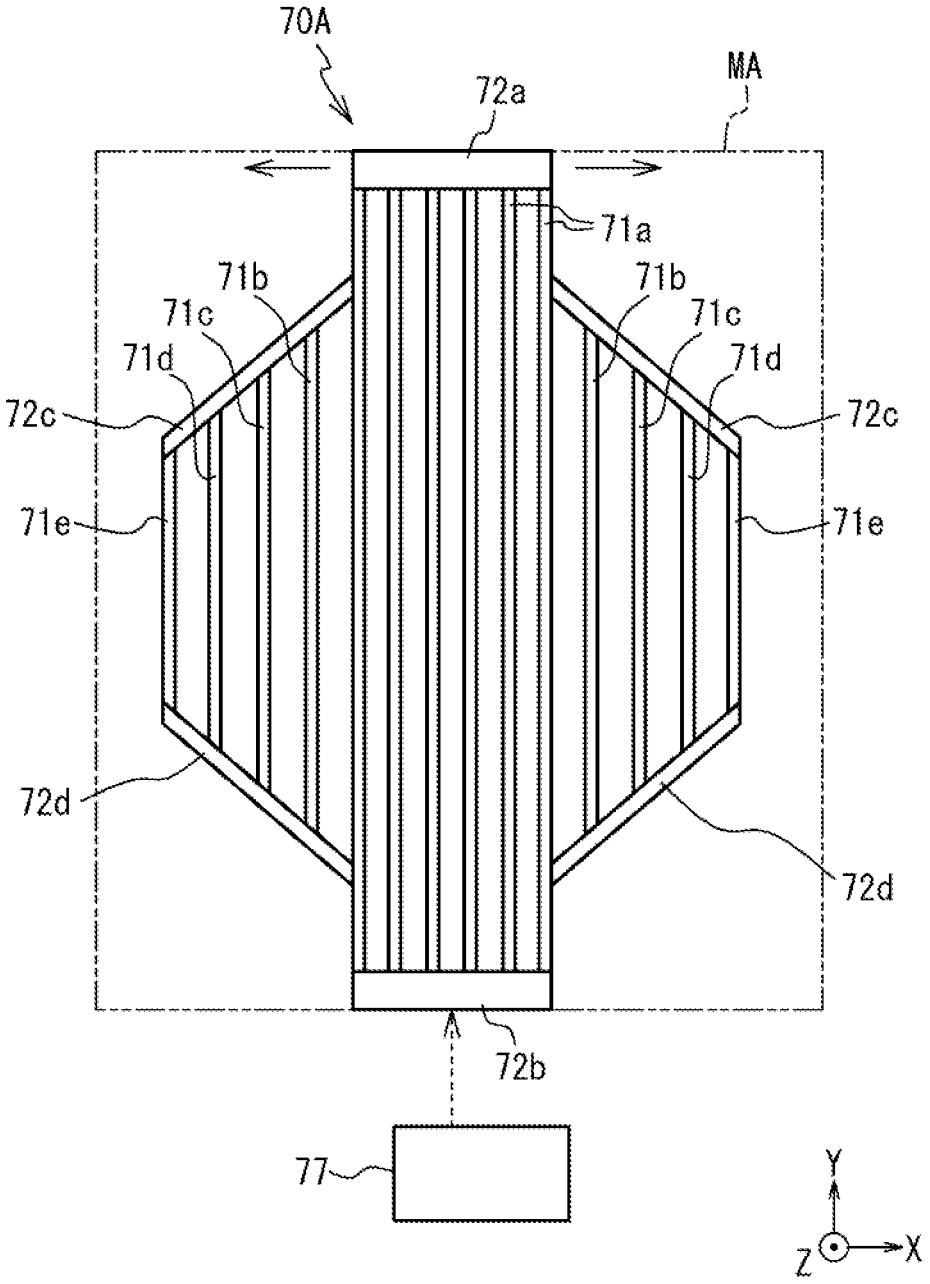
FIG. 9 is a schematic plan view of a paddle according to Modification 3 of the embodiment.

FIG. 9 is a schematic plan view of a paddle 70A according to Modification 3 of the embodiment. The paddle 70A according to this modification is unlike the paddle 70 illustrated in FIG. 5 described above in that, beside the "plurality of stirring members 71*a* (that is, a first stirring member group)," a "plurality of stirring members 71*b*, 71*c*, 71*d*. 71*e* (that is, a second stirring member group)" having shorter lengths in the extending direction compared with the stirring members 71*a* are further included.

Specifically, the paddle 70A according to this modification includes the stirring members 71*b*, 71*c*, 71*d*. 71*e* on each the first direction side and the second direction side of the plurality of stirring members 71*a*.

Note that, as illustrated in FIG. 9, the more distanced the stirring members 71*b*, 71*c*, 71*d*, 71*e* become from the stirring members 71*a*, the shorter the lengths in the extending direction of the stirring members 71*b*, 71*c*, 71*d*, 71*e* may become. Furthermore, one ends of the stirring members 71*b*, 71*c*, 71*d*, 71*e* may be coupled to coupling members 72*c*, and other ends may be coupled to coupling members 72*d*.

According to this modification, since the paddle 70A includes the stirring members 71*b*, 71*c*, 71*d*. 71*e*, for example, compared with the paddle 70 in FIG. 5, an area stirrable with the paddle 70A when the paddle 70A moves a constant distance can be expanded.

Note that, the plating apparatus 1000 including the paddle 70A according to this modification performs the process described in FIG. 6 described above. In Modification 1 and Modification 2 described above, the paddle 70A according to this modification may be used instead of the paddle 70.

(Modification 4)

Figure 10:
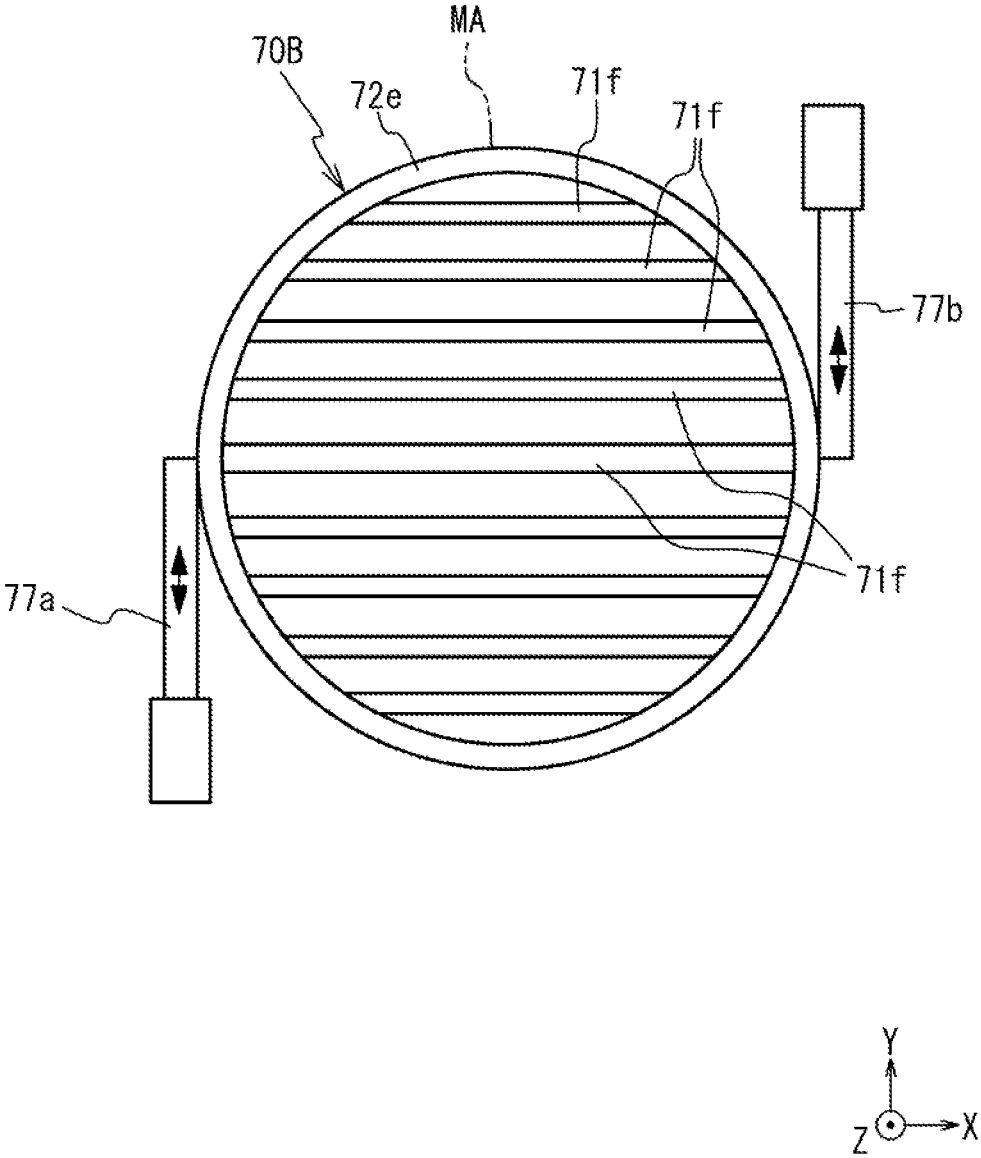
FIG. 10 is a schematic plan view of a paddle according to Modification 4 of the embodiment.

FIG. 10 is a schematic plan view of a paddle 70B according to Modification 4 of the embodiment. The paddle 70B according to this modification is unlike the paddle 70 illustrated in FIG. 5 in that a plurality of stirring members 71*f* extending in a predetermined direction and a coupling member 72*e* that couples both ends of each stirring member 71*f* are included and the coupling member 72*e* has a ring shape in a plan view.

Furthermore, the paddle 70B according to this modification is unlike the paddle 70 illustrated in FIG. 5 also in the point of being driven to rotate within a horizontal surface by a driving device 77*a* and a driving device 77*b*. Specifically, the driving device 77*a* drives the coupling member 72*e* of the paddle 70B alternately in the Y-direction and the −Y-direction. The driving device 77*b* drives the coupling member 72*e* alternately in the Y-direction and the −Y-direction. Accordingly, with the center of the ring-shaped coupling member 72*e* as a rotational center, the paddle 70B rotates within the horizontal surface alternately in the first rotation direction (such as the clockwise direction in a plan view) and the second rotation direction opposite to the first rotation direction (such as the counterclockwise direction in a plan view).

Even in this modification, since the plating solution Ps can be stirred with the paddle 70B, the gas bubbles Bu attached to the holes 12*a* of the ionically resistive element 12 can be removed.

Note that, the plating apparatus 1000 including the paddle 70B according to this modification performs the process described in FIG. 6 described above. In Modification 1 and Modification 2 described above, the paddle 70B according to this modification may be used instead of the paddle 70.

(Modification 5)

Figure 11:
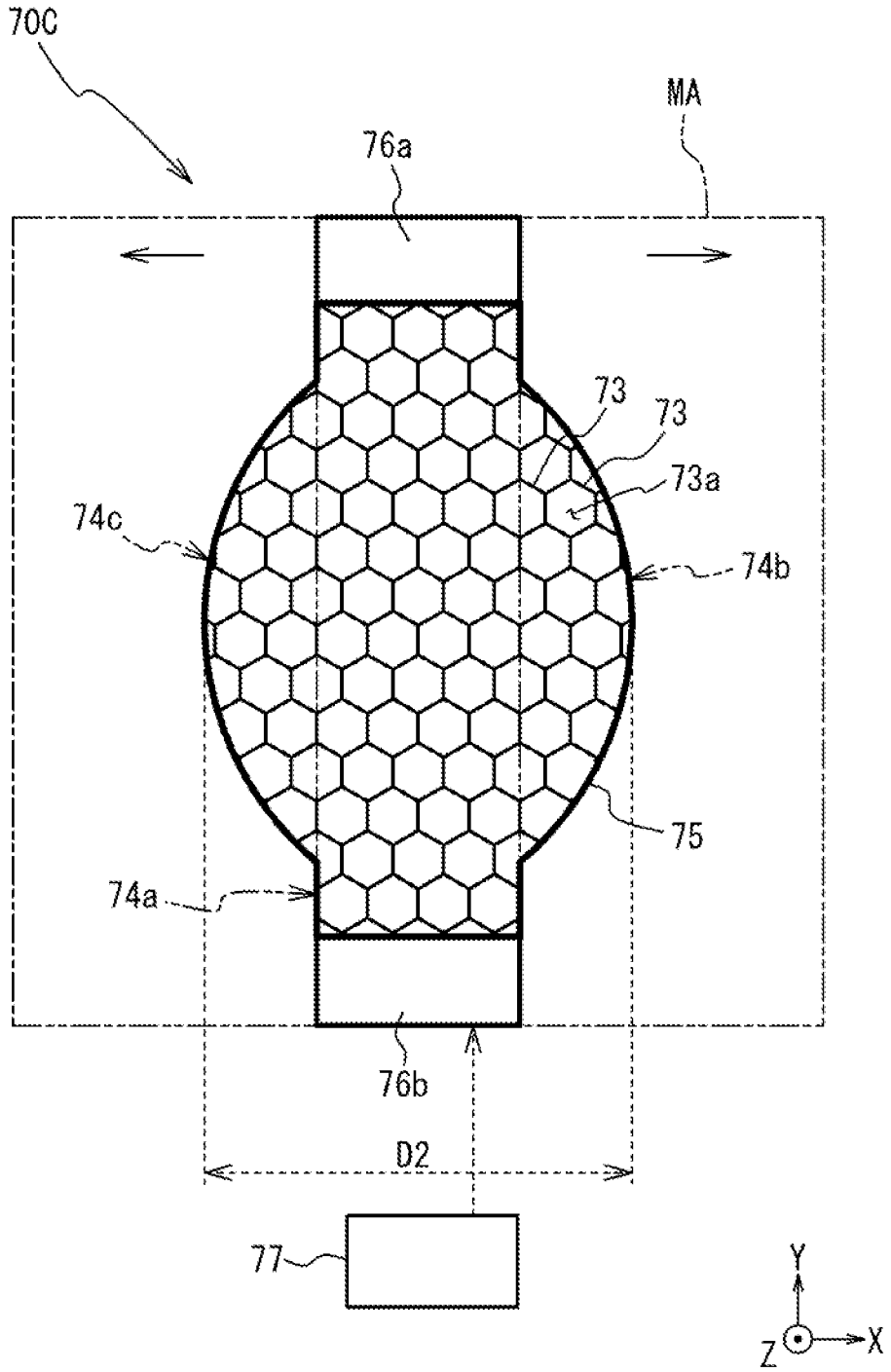
FIG. 11 is a schematic plan view of a paddle according to Modification 5 of the embodiment.

FIG. 11 is a schematic plan view of a paddle 70C according to Modification 5 of the embodiment. The paddle 70C according to this modification is unlike the paddle 70 illustrated in FIG. 5 in the point of including a plurality of stirring members 73 constituting a honeycomb structure. Furthermore, as illustrated in FIG. 11, the paddle 70C according to this modification may further include a covering frame 75 and outer frames 76*a*, 76*b*.

Each stirring member 73 constitutes a polygonal through-hole 73*a* extending in an upper/lower direction (vertical direction). A specific shape of the polygon of the through-hole 73*a* is not particularly limited, and various kinds of N polygons (N is a natural number of three or more) such as a triangle, a quadrangle, a pentagon, a hexagon, a heptagon, an octagon, and the like can be used. In this modification, a hexagon is used as an example of the polygon.

The plurality of stirring members 73 include a polygonal portion 74*a* having a quadrangle shape in a plan view. Specifically, the polygonal portion 74*a* according to this modification has a rectangular shape extending in the horizontal direction with a perpendicular direction (Y-axis direction) with respect to the first direction and the second direction being the longitudinal direction. However, it is not limited to this configuration, and the polygonal portion 74*a* may have a rectangular shape with the first direction and the second direction being the longitudinal direction, or may have a square shape.

The plurality of stirring members 73 include a first projecting portion 74*b* projecting from a side surface on the first direction side of the polygonal portion 74*a* toward the first direction side and a second projecting portion 74*c* projecting from a side surface on the second direction side of the polygonal portion 74*a* toward the second direction side. That is, an outer edge of the plurality of stirring members 73 according to this modification has an appearance shape including the polygonal portion 74*a*, the first projecting portion 74*b*, and the second projecting portion 74*c* in a plan view. The first projecting portion 74*b* according to this modification projects in an arc-like shape (in other words, a bow-like shape) toward the first direction. The second projecting portion 74*c* according to this modification projects in an arc-like shape (in other words, a bow-like shape) toward the second direction.

The covering frame 75 is disposed so as to cover the outer edges of the plurality of stirring members 73. An outer frame 76*a* is connected to a side surface on one of sides (Y-direction side) of the covering frame 75. An outer frame 76*b* is connected to a side surface on another side (−Y-direction side) of the covering frame 75. The paddle 70C is connected to the driving device 77, and is driven alternately in the first direction and the second direction by the driving device 77. Specifically, in the paddle 70C according to this modification, the outer frame 76*b* of the paddle 70C is connected to the driving device 77.

Even in this modification, since the plating solution Ps can be stirred with the paddle 70C, the gas bubbles Bu attached to the holes 12*a* of the ionically resistive element 12 can be removed.

Furthermore, according to this modification, since the paddle 70C has a honeycomb structure, compared with a case where the paddle 70C does not have a honeycomb structure and, for example, is configured of a rod-shaped or a plate-shaped member extending perpendicular to the driving direction of the paddle 70C (such as in the case of FIG. 5 described above), an arrangement density of the plurality of stirring members 73 can be increased. Accordingly, the plating solution Ps can be effectively stirred with the paddle 70C. As a result, the gas bubbles Bu attached to the holes 12*a* of the ionically resistive element 12 can be effectively removed.

Furthermore, with this modification, since the plurality of stirring members 73 of the paddle 70C include the polygonal portion 74*a*, the first projecting portion 74*b*, and the second projecting portion 74*c*, for example, compared with a case where the plurality of stirring members 73 include the polygonal portion 74*a* but does not include the first projecting portion 74*b* or the second projecting portion 74*c*, an area stirrable with the paddle 70C when the paddle 70C moves a constant distance can be expanded.

Note that, a "paddle width D2" as a maximum value of a distance between the first projecting portion 74*b* and the second projecting portion 74*c* may be larger or smaller than a "substrate width D1 (whose reference numeral is denoted in FIG. 3)" as a maximum value of a distance between an outer edge in the first direction and an outer edge in the second direction of the surface to be plated Wfa of the substrate Wf. Alternatively, the paddle width D2 may have the same value as the substrate width D1.

However, in a case where the paddle width D2 is smaller than the substrate width D1, compared with a case where the paddle width D2 is the same as the substrate width D1 or greater than the substrate width D1, a larger clearance between the paddle 70C and the outer peripheral wall 10*b* of the plating tank 10 can be ensured. As a result, a moving distance in the first direction and the second direction of the paddle 70C inside the plating tank 10 (that is, a stroke of the reciprocation movement of the paddle 70C) can be increased. Accordingly, since the plating solution Ps can be effectively stirred with the paddle 70C, the gas bubbles Bu attached to the holes 12*a* of the ionically resistive element 12 can be effectively removed. In these terms, the paddle width D2 is preferred to be smaller than the substrate width D1.

Note that, in a case where the surface to be plated Wfa of the substrate Wf has a circular shape, the substrate width D1 corresponds to a diameter of the surface to be plated Wfa. In a case where the surface to be plated Wfa of the substrate Wf has a quadrangle shape, the substrate width D1 corresponds to a maximum value of a clearance between a side in the first direction of the surface to be plated Wfa and an opposing side (side in the second direction).

The plating apparatus 1000 including the paddle 70C according to this modification performs the process described in FIG. 6 described above. However, the configuration is not limited to this. As another example, the plating apparatus 1000 according to this modification may perform the stirring of the plating solution Ps with the paddle 70C only either when supplying the plating solution Ps to the plating tank 10 (step S10, step S20), or when performing the plating process on the substrate Wf (step S50, step S60). Furthermore, in modification 1 (FIG. 7) and modification 2 (FIG. 8) described above, the paddle 70C according to this modification may be used instead of the paddle 70.

Although the embodiments and modifications of the present invention have been described in detail above, the present invention is not limited to such specific embodiments or modifications, and further various kinds of variants and modifications are possible within the scope of the present invention described in the claims.

REFERENCE SIGNS LIST

10 . . . plating tank
11 . . . anode
12 . . . ionically resistive element
12*a* . . . hole
30 . . . substrate holder
70, 70A, 70B, 70C . . . paddle
73 . . . stirring member
73*a* . . . through-hole
74*a* . . . polygonal portion
74*b* . . . first projecting portion
74*c* . . . second projecting portion
1000 . . . plating apparatus
Wf . . . substrate
Ps . . . plating solution
Bu . . . gas bubbles

The invention claimed is:

1. A plating method comprising:

supplying a plating solution to a plating tank provided with an anode and an ionically resistive element arranged above the anode and having a plurality of holes, and immersing the anode and the ionically resistive element in the plating solution;

stirring the plating solution by driving a paddle arranged above the ionically resistive element in a state where the anode and the ionically resistive element are immersed in the plating solution;

immersing a substrate as a cathode in the plating solution in a state where the stirring of the plating solution with the paddle is stopped;

resuming the stirring of the plating solution with the paddle arranged above the ionically resistive element and below the substrate in a state where the substrate is immersed in the plating solution; and performing a plating process on the substrate by flowing electricity between the substrate and the anode in a state where the stirring of the plating solution with the paddle is resumed.

2. The plating method according to claim 1, further comprising causing the plating solution to overflow from the plating tank in a state where the stirring of the plating solution with the paddle is stopped, wherein the immersing of the substrate in the plating solution in a state where the stirring of the plating solution with the paddle is stopped is performed after causing the plating solution to overflow from the plating tank.

3. The plating method according to claim 1, further comprising:

pulling the substrate out of the plating solution after a plating process is performed on the substrate;

stirring the plating solution by driving the paddle arranged above the ionically resistive element in a state where the substrate is pulled out of the plating solution;

immersing a second substrate in the plating solution in a state where the stirring of the plating solution with the paddle is stopped;

resuming the stirring of the plating solution with the paddle arranged above the ionically resistive element and below the second substrate in a state where the second substrate is immersed in the plating solution; and performing a plating process on the second substrate by flowing electricity between the second substrate and the anode in a state where the stirring of the plating solution with the paddle is resumed.

4. The plating method according to claim 1, wherein the immersing of the substrate in the plating solution in a state where the stirring of the plating solution with the paddle is stopped includes immersing the substrate in the plating solution in a state where the stirring of the plating solution with the paddle is stopped and in a state where a surface to be plated of the substrate is inclined with respect to a horizontal direction.

5. The plating method according to claim 4, further comprising returning the surface to be plated of the substrate in a state of being immersed in the plating solution to the horizontal direction, wherein the resuming of the stirring of the plating solution with the paddle in a state where the substrate is immersed in the plating solution is performed after returning the surface to be plated of the substrate in a state of being immersed in the plating solution to the horizontal direction.

6. The plating method according to claim 1, wherein a flow rate of the plating solution flowing from a lower surface side of the ionically resistive element, passing through the plurality of holes, and flowing toward an upper surface side of the ionically resistive element when stirring the plating solution by driving the paddle in a state where the anode and the ionically resistive element are immersed in the plating solution is greater than a flow rate of the plating solution when performing a plating process on the substrate.

7. The plating method according to claim 1, wherein the paddle is driven alternately in a first direction parallel to the upper surface of the ionically resistive element and a second direction opposite to the first direction to stir the plating solution.

8. The plating method according to claim 7, wherein the paddle has a honeycomb structure including a plurality of stirring members constituting a plurality of polygonal through-holes extending in an upper/lower direction, and the plurality of stirring members include a polygonal portion having a quadrangle shape, a first projecting portion projecting in an arc-like shape from a side surface on the first direction of the polygonal portion to the first direction, and a second projecting portion projecting in an arc-like shape from a side surface on the second direction of the polygonal portion to the second direction, in a plan view.

9. The plating method according to claim 8, wherein a paddle width as a maximum value of a distance between the first projecting portion and the second projecting portion is smaller than a substrate width as a maximum value of a distance between an outer edge in the first direction and an outer edge in the second direction of the surface to be plated of the substrate on which a plating process is performed.

* * * * *